US006210258B1

(12) United States Patent
Malkin et al.

(10) Patent No.: US 6,210,258 B1
(45) Date of Patent: Apr. 3, 2001

(54) VIBRATIONAL FINISHING ASSEMBLY

(75) Inventors: Daniel Malkin; Lev Malkin, both of Toronto (CA)

(73) Assignee: Vibro Finish Tech Inc., Toronto (CA)

( * ) Notice: Subject to any disclaimer, the term of this patent is extended or adjusted under 35 U.S.C. 154(b) by 0 days.

(21) Appl. No.: 09/442,986

(22) Filed: Nov. 19, 1999

(51) Int. Cl.[7] ..... B24B 19/00

(52) U.S. Cl. ..... 451/74; 451/32; 451/85; 451/326; 451/328

(58) Field of Search ..... 451/32, 35, 74, 451/85, 326, 328, 330

(56) References Cited

U.S. PATENT DOCUMENTS

| | | | | |
|---|---|---|---|---|
| 3,161,993 | | 12/1964 | Balz . | |
| 3,400,495 | | 9/1968 | Balz . | |
| 4,001,979 | | 1/1977 | Elkins et al. . | |
| 4,034,521 | | 7/1977 | Balz . | |
| 4,042,181 | * | 8/1977 | Huber et al. | 451/326 |
| 4,090,332 | | 5/1978 | Rampe . | |
| 4,143,491 | * | 3/1979 | Blanc | 451/326 |
| 4,228,619 | | 10/1980 | Anderson . | |
| 4,520,598 | | 6/1985 | Rampe . | |

* cited by examiner

*Primary Examiner*—David A. Scherbel
*Assistant Examiner*—Shantese McDonald
(74) *Attorney, Agent, or Firm*—Bereskin & Parr

(57) ABSTRACT

A finishing assembly for vibratory finishing of workpieces in loose finishing media includes at least one generally annular finishing chamber which is driven by a drive assembly and supported by a support housing. The drive assembly consists of a crank shaft and a drive shaft which are rigidly connected to each other through a wedge-shaped gasket and oriented such that the rotary axis of the crank shaft and the rotary axis of the drive shaft intersect with one another at a predetermined angle. The crank shaft rotates within a first bearing hub which is rigidly mounted within the chamber and the drive shaft rotates within a second bearing hub which is rigidly secured to the assembly housing and which is actuated by an electric motor. The spatial vibration of the finishing assembly can be adjusted using a wedge-shaped gasket and/or by providing for horizontal displacement of the first bearing hub from the second bearing hub. The assembly housing acts as a reactive mass so that the finishing assembly experiences kinematic motion. Alternatively, the finishing assembly may include a second chamber to serve as a reactive mass, the second chamber being mounted either on the same level with the first chamber or underneath it. A special chute/groove arrangement can be provided to convey workpieces out of the first chamber and/or second chamber.

12 Claims, 6 Drawing Sheets

VIBRATIONAL FINISHING ASSEMBLY

FIELD OF THE INVENTION

The present invention relates to vibratory finishing machines, and more particularly to an improved vibrational finishing assembly.

BACKGROUND OF THE INVENTION

Finishing machines are used to perform finishing operations such as deburring, burnishing, descaling, cleaning and the like. Such machines include a movably mounted chamber and a drive system for vibrating the receptacle. Workpieces to be finished are loaded into the chamber together with finishing media. A finishing action is imparted to the workpieces by vibrating the chamber so that the mixture of workpieces and media is effectively maintained in a fluid or mobile state with smaller components of the mixture dispersed between larger components so that the larger components receive finishing treatment from the smaller components. Impulse forces imparted to the mixture not only cause repeated impacts among its components but also cause the mixture to chum in a predictable manner as a finishing process is carried out.

Two basic types of unbalanced-mass vibratory finishing machines are in common use. An earlier type of finishing machine such as that described in U.S. Pat. No. 4,228,619 to Anderson employs an elongate chamber which defines an elongate, trough-like finishing chamber extending in a substantially horizontal plane, and which is vibrated by rotating one or more eccentrically-weighted drive shafts about one or more substantially horizontally axes extending along the chamber. This type of machine is known in the art as a "tub machine".

Another, newer type of machine such as that described in U.S. Pat. No. 3,161,993 to Balz, uses a substantially toroidal-shaped chamber which defines an annular, trough-like finishing chamber extending in a generally horizontal plane, and which is vibrated by rotating an eccentrically-weighted drive shaft about a substantially vertical "center axis" located centrally of the chamber when the chamber is at rest. This type of machine is known in the art as a "bowl machine".

Both types of machines use inertial centrifugal vibrators (i.e. unbalanced mass type mechanisms) to provide vibrations excitation. It is important to be able to increase the amplitude of the vertical velocity vibrations in order to increase the intensity (i.e. velocity) of the finishing process. However, unbalanced-mass finishing machines are prone to a number of operational disadvantages.

First, when the machine power supply is turned off and braking is applied to the drive shaft, the large machine components rapidly lose their accumulated energy. When the rotation frequency of the drive mechanism coincide with the vibrations of the larger machine components on an elastic suspension there is a corresponding increase in the non-stationary vibratory load that acts on the floor or foundation of the building where the finishing machine is mounted. In order to avoid the horizontal displacement of the machine when it is turned off, it is necessary to secure the elastic suspension of the chamber to the heavy base which in turn significantly limits the intensity of the working vibrations of the machine and, consequently, the finishing intensity.

Generally, the amplitude of the transitional regime is known to increase with the increase of the amplitudes of the operational regime and with the increase of the polar moment of inertia of the unbalanced shaft. Therefore, in practice, in order to achieve an acceptably high amplitude of the operational vibrations in unbalanced-mass vibratory machines, the double amplitude of vibrations is limited (e.g. to between 4 and 8 millimeters), and the frequency of operational vibrations is increased (e.g. above 1200 rpm). However, such increases in frequency requires the rigidity of the chamber and the machine to be increased and accordingly the loads acting on the supports and the associated noise level increase as well.

Also, designers of both types of finishing machines have attempted to provide a simple and relatively inexpensive, yet reliable system which will enable a truly aggressive finishing action to be imparted to the contents of the chamber. A challenge facing the industry has been to provide an efficient bowl machine design which is capable of generating the type of large amplitude velocity vibrations needed to provide an aggressive finishing action, while minimizing the use of inordinately massive and costly machine components.

Accordingly, there is a need for an improved finishing assembly which provides aggressive finishing action while using a low-energy input drive system, which comprises relatively few parts, and which is durable and relatively inexpensive to manufacture.

BRIEF SUMMARY OF THE INVENTION

It is therefore an object of the present invention to provide a finishing assembly for vibratory finishing of a group of workpieces within finishing media, said finishing assembly comprising:

(a) a first chamber adapted to hold the finishing media for finishing the surfaces of the workpieces;

(b) a crank shaft operably connected to said first chamber, said crank shaft having a first rotary axis;

(c) a drive shaft driveably operated and operably connected to said crank shaft for driving said crank shaft, said drive shaft having a second rotary axis;

(d) a coupling member operably connecting said crank shaft to said drive shaft with said first rotary axis of said crank shaft and said second rotary axis of said drive shaft intersecting with one another at a predetermined angle;

(e) a restraining element coupled to said first chamber for restraining said first chamber from rotational movement; and (f) a reactive mass operative connected to said drive shaft for providing vibrational stability to said finishing assembly.

Further objects and advantages of the invention will appear from the following description, taken together with the accompanying drawings.

DETAILED DESCRIPTION OF PREFERRED EMBODIMENTS

Figure 1:
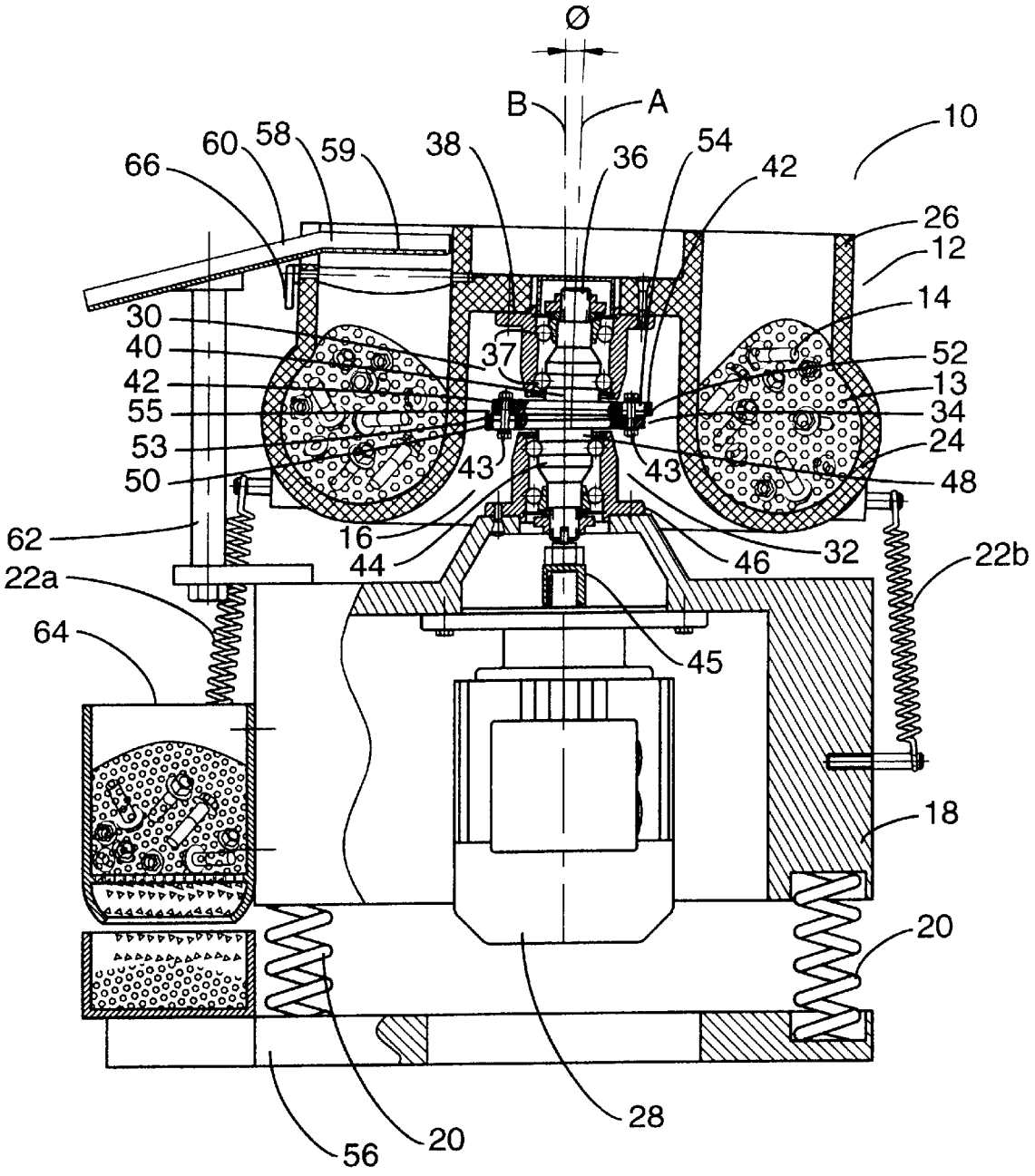
FIG. 1 is a side cross-sectional view of the finishing assembly according to a preferred embodiment of the present invention.

Reference is first made to FIG. 1 which shows a finishing assembly 10 made in accordance with a preferred embodiment of the invention. Finishing assembly 10 includes a chamber 12 for holding finishing media 13 for treating a group of workpieces 14, a drive assembly 16, a support housing 18, shock absorbers 20, and restraining elements 22*a* and 22*b*.

Chamber 12 is of a conventionally known shape, namely having a circular toroidal bottom 24 and cylindrical walls 26 extending from the toroidal bottom 24. Chamber 12 is made of a durable material (e.g. hard plastic). It should be understood that the specific shape of chamber 12 is not of principal concern and that a chamber 12 of any other known shapes may be used in association with the invention.

Drive assembly 16 is actuated by a motor 28 (e.g. an electric motor) and includes a crank assembly 30, a drive shaft assembly 32 and a coupling assembly 34. Crank assembly 30 comprises a crank 36 which rotates in roller bearings 37 in a first bearing hub 38 as well as a crank journal 40 having a flat flange 42. Drive shaft assembly 32 comprises a drive shaft 44 which rotates in second bearing hub 46 as well as a drive journal 48 having a flat flange 50. Drive shaft 44 is coupled to motor 28 through coupling 45.

The operational parameters of finishing assembly 10 depend significantly on the design of the crank assembly 30 and on the carrying capacity of the bearing units (i.e. first and second bearing hubs 38, 46 etc.) when loaded by rotating vectors of forces and moments that are perpendicular to the axes of crank 36 and drive shaft 44. It is contemplated that finishing assembly 10 would use automobile wheel supports as the bearing units as such supports are readily available and are generally designed to meet the requirements of a kinematic vibrational drive. It has been observed that wheel supports provide additional convenience due to their compact size as well as their ease of mounting and operation.

Coupling assembly 34 comprises an adjustable wedge gasket 52 which can be adjusted to change the overall inclination of the axis of crank 36 (line A) relative to the axis of drive shaft 44 (line B). Coupling assembly 34 is bolted to flange 42 of crank assembly 30 and to flange 50 of drive shaft assembly 32 using bolts 43. Coupling assembly 34 provides the central axis of crank assembly 30 with a different angle of orientation than the central axis of drive shaft assembly 32, as shown.

The angle ø between the rotary axis of crank 36 and the rotary axis of drive shaft 44 (i.e. the phase angle ø between lines A and B) can be adjusted using wedge gasket 52. Specifically, wedge gasket 52 consists of two separate wedges 53 and 55, such that relative rotation of individual wedges 53 and 55 changes the general angle of inclination between crank 36 and drive shaft 44. Also, the radial displacement of crank flange 42 in relation to the drive shaft flange 50 produces a certain eccentricity between crank 36 and drive shaft 44 and the required phase displacement can be set by turning wedge gasket 52 in relation to the direction of the eccentricity.

Flange 42 can be displaced radially about the axis of drive shaft 44 in respect of flange 50 using various mechanisms including, for example, the grooves 54 shown formed in flanges 42 and 50. This displacement determines the eccentricity of crank 36 in respect of drive shaft 44. The rotation of wedge gasket 52 determines the angle ø between the crank shaft 36 and the drive shaft 44. It should be understood that coupling assembly 34 could also comprise any other type of mechanism (e.g. a conjugated cylindrical pair) which could be used to change the overall inclination of crank 36 in respect of drive shaft 44. It should be understood that the optimal angle of inclination ø for operation is determined by the specific parameters (i.e. mass, moments of inertia etc.) of the various components of finishing assembly 10.

Support housing 18 is used to house part of drive assembly 16 as well as motor 28 and is coupled to a base 56 through shock absorbers 20. It has been determined that absorbers 20 should be designed to have rigidity such that the frequency of finishing assembly 10 is many times less than the rotational speed of the drive shaft 44. Chamber 12 is prevented from rotating by the attachment of restraining elements 22*a* and 22*b* (e.g. helical coil springs) which are coupled to housing 18 and to chamber 12, as shown. While motor 28 is shown coupled to housing 18 co-axially with drive shaft 44, it should be understood that motor 28 could also be mounted directly on base 56 in order to protect motor 28 from stray vibrations of finishing assembly 10.

Finishing assembly 10 also utilizes a separator 58 and a chute 60 which are secured to housing 18 by a holder 62 so that finished workpieces 14 can be delivered out of chamber 12, possibly into a separate receptacle (e.g. reservoir 64). Separator 58 is secured to the walls of chamber 12 above the level of finishing media 13 and has a screen 59 located at its bottom. During the finishing process a flap 66 is opened to let finishing media 13 flow through and into separator 58. Due to the inherent head pressure of the vibrating loose media flow of workpieces 14 and media 13 is driven up above the upper rib of the flap 66 and lands on screen 59 of separator 58. Granules or particles of finishing media 13 pass through the openings in screen 59 back onto the bottom of chamber 12, while the screened workpieces 14 are conveyed by chute 60 out of chamber 12. This simple separation method is not acceptable in cases, where due to excessive intensity of vibrations of separator 58 and chute 60, the workpieces 14 separated from finishing media 13 jump so strongly as to get damaged. In such cases, damage can be avoided by securing the screen 59 and the chute 60 to housing 18 and not to chamber 12.

When drive shaft 44 is rotated and drives crank 36 within first bearing hub 38, chamber 12 is provided with kinematic motion having an adjustable range of angular and circular horizontal vibrations and phase shift/angle between vibrations. It is possible to increase the amplitude of the vibrational movement by adjusting the relative angle and eccentricity between crank 36 and drive shaft 44. Thus, it is possible to increase the amplitude of vibration without having to increase the unbalanced masses and moment of inertia of the drive as is necessary in the case of conventional unbalanced-mass drives. Rather, the amplitudes can be affected by the angle of wedge gasket 52 and the average distance between the centre of chamber 12 and the middle of the chamber 12 (i.e. depends on the dimension of chamber 12).

The angle ø between the respective axes of crank 36 and drive shaft 44, the distance between the respective axes of crank 36 and drive shaft 44 (i.e. eccentricity therein) along with the location of the centre of mass of chamber 12 and housing 18 and the ratio of the masses and the moments of inertia therein, all influence and determine the extent of the spatial vibrations of chamber 12. The phase angle between the horizontal projection of the axis of crank 36 and the direction of eccentricity of the axis of crank 36 also affects the dynamics of the machine.

Generally, chamber 12 vibrates in space such that points of chamber 12 located along one horizontal plane, travel along elliptical paths having identical circular horizontal projections and having an amplitude of vertical oscillation that is proportional to the distance between the specific point and the center of the axis of drive shaft 44. Accordingly, the character of vibrations of chamber 12 in the present invention is similar to movement of finishing chambers of known machines with unbalanced mass drives and the corresponding movement of loose media contained within chamber 12 is also similar.

Also, housing 18 of finishing assembly 10 serves as a reactive masse in relation to the mass of chamber 12 and finishing media 13. The vibration of this reactive mass (i.e. housing 18) about the immobile common centre of masses of the finishing assembly 10, efficiently balances the movement of chamber 12 and media 13 which moves independently within chamber 12. It should be noted that the role of the reactive mass (i.e. housing 18 in this embodiment) does not have to be as "passive" as it usually is in typical prior art unbalanced-mass machines. In contrast, the reactive mass can itself be used to perform further finishing functions as will be further described in association with alternate embodiments of the invention.

Moreover, the character and intensity of the vibrations of the said reactive mass (i.e. housing 18) and the main mass (i.e. chamber 12) are controllable as it should be appreciated that the respective vibrational amplitudes of these masses can be set within a wide range, for example, by appropriately setting the angle ø between the drive shaft and the crank shaft. Thus, the vibrations of housing 18 can be used for performing additional operations (e.g. separation and/or drying of workpieces inside container 64 etc.) As another example, if separators (e.g. screens, grates) are located inside the chamber are secured not to the container itself but to housing 18 (as described in respect of FIG. 1), excessive throwing up of the screened parts on the separator and chute can be avoided (provided that the housing weight is larger than that of the chamber).

Accordingly, the design of the present invention achieves a wide range of vibratory amplitude regulation at a low moment of inertia between drive shaft 44 and crank 36. Due to the kinematical connection between the vibrating elements of finishing assembly 10 (i.e. chamber 12 and housing 18) and a low kinematical energy of the rotating elements of crank 36 and drive shaft 44, finishing assembly 10 can pass through the resonance zones when finishing assembly 10 is turned off, without any appreciable increase of the vibrations amplitude. This robustness of finishing assembly 10 allows for operation within a wider range of vibration velocities than is the case in typical prior art vibratory finishing machines. An increase in the velocity of assembly 10 can be achieved by simultaneously reducing the operational frequency of vibrations (by 1.5 to 2-fold) due to a many fold (3 to 4-fold) increase of the amplitudes. Accordingly, the velocity of treatment of workpieces 14 increases.

Finally, due to the kinematic connection between chamber 12 and a reactive mass (e.g. housing 18), finishing assembly 10 becomes less sensitive to changes in the weight of finishing media 13 loaded into chamber 12. This is because, the change in finishing intensity within finishing assembly 10 is determined not by the ratio of the change in weight within chamber 12 to weight of chamber 12 (as is the case with unbalanced-mass vibratory machines) but is determined by the ratio of the change in weight to the sum of the weights of chamber 12 and reactive mass (e.g. housing 18). This results in a much more robust finishing assembly 10 than has been previously attainable.

Figure 2:
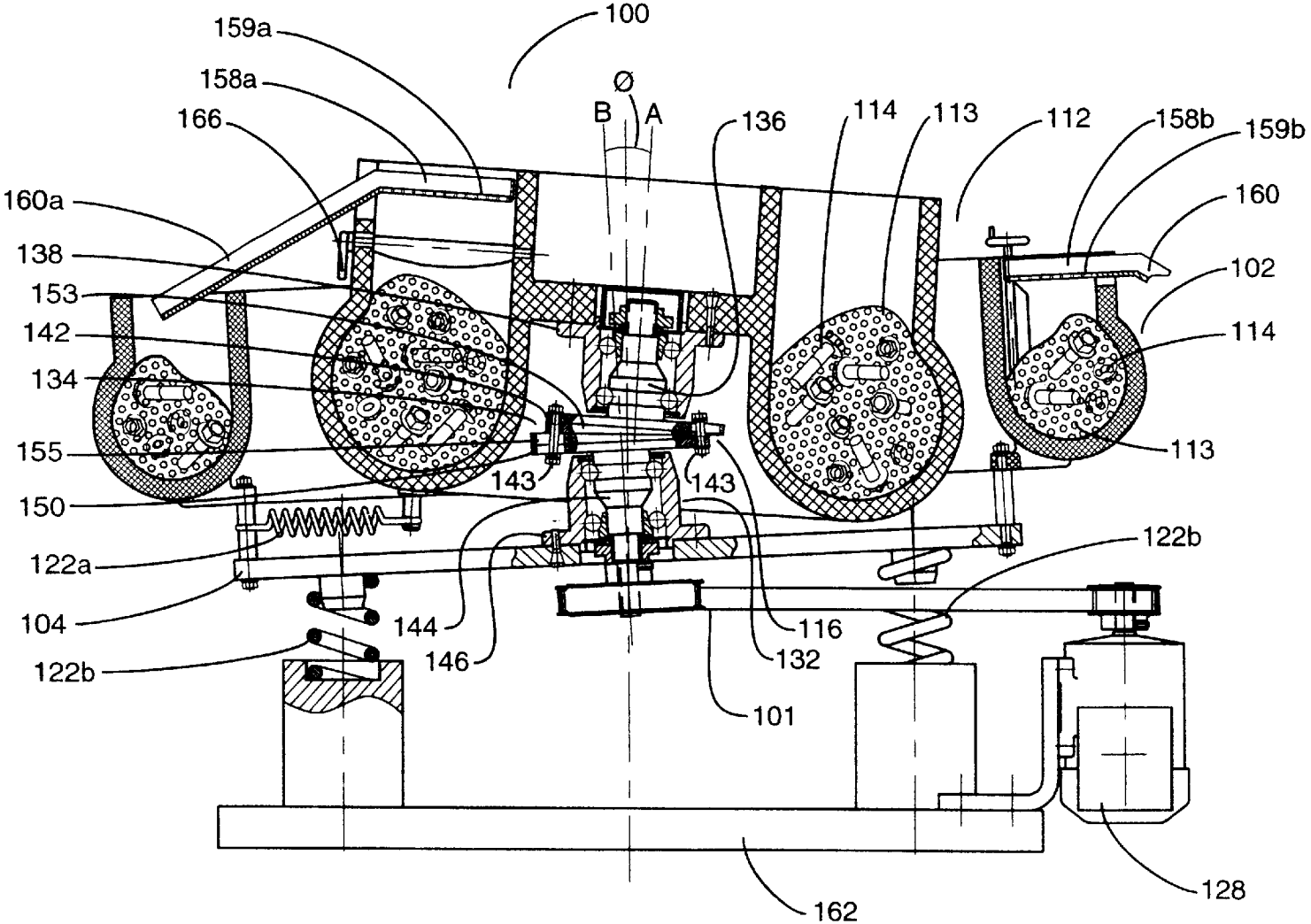
FIG. 2 is a side cross-sectional view of the finishing assembly according to an alternative embodiment of the present invention.

FIG. 2 shows an alternative embodiment of finishing assembly 100 of the present invention wherein a second chamber 102 is positioned concentrically with chamber 112 in order to provide additional finishing capacity for finishing assembly 100. Common elements between the alternative finishing assembly 100 and the finishing assembly 10 will be denoted by the same numerals but with one hundred added thereto.

By utilizing a second chamber 102, it is possible to further exploit the benefits of the kinematical drive as second chamber 102 will also act as a reactive mass. Essentially, there is no housing, as such, in this embodiment and accordingly, the role of the reactive mass is being played by the second chamber 102 and its mounting plate 104. Second chamber 102 is located concentrically with chamber 112. Chamber 112 is mounted similarly to chamber 10 of FIG. 1. Generally, both chamber 112 and chamber 102 act as reactive masses for each other and vibrate in the opposite phases around the centre of mass of finishing assembly 100.

The ratio of intensity of vibrations of the opposite phases is most simplistic when second chamber 102 is placed concentrically with chamber 112 (i.e. the centres of gravity of chamber 112 and second chamber 102 are located at the same level). The amplitudes of angular and circular vibrations will be inversely proportional to the corresponding moments of energy and masses of the respective chambers.

If the centres of mass of chambers 112 and 102 are on the same horizontal level, then, in order to ensure identical processing conditions in both chambers, chambers 112 and 102 must have equal masses, while the ratio of their moments of inertia about the central horizontal axes has to be equal to the ratio of the radiuses of the middle of the chutes. It must be noted that, base 156 serves as a shock absorber for both the dynamic system comprising chambers 112 and 102 as well as motor 128 of finishing assembly 100. Also, base 156 supports electric motor 128 which actuates drive shaft 44 via a conventionally known belt drive 101.

As shown, workpieces 114 can be transferred from chamber 112 to chamber 102 from separator **158*a* through chute 160*a*. Granules or particles of finishing media 113 pass through the openings in screen 159*a* back onto the bottom of chamber 112, while the screened workpieces 114 are conveyed by chute 160 out of chamber 112 and into second chamber 102. Workpieces 114 can then be transferred from chamber 102 to a reservoir (not shown) external to finishing assembly 100, from separator 158*b* through chute 160*b*. Granules or particles of finishing media 113 pass through the openings in screen 159*b* back onto the bottom of chamber 102, while the screened workpieces 114 are conveyed by chute 160*b* out of finishing assembly 100**.

Figure 3:
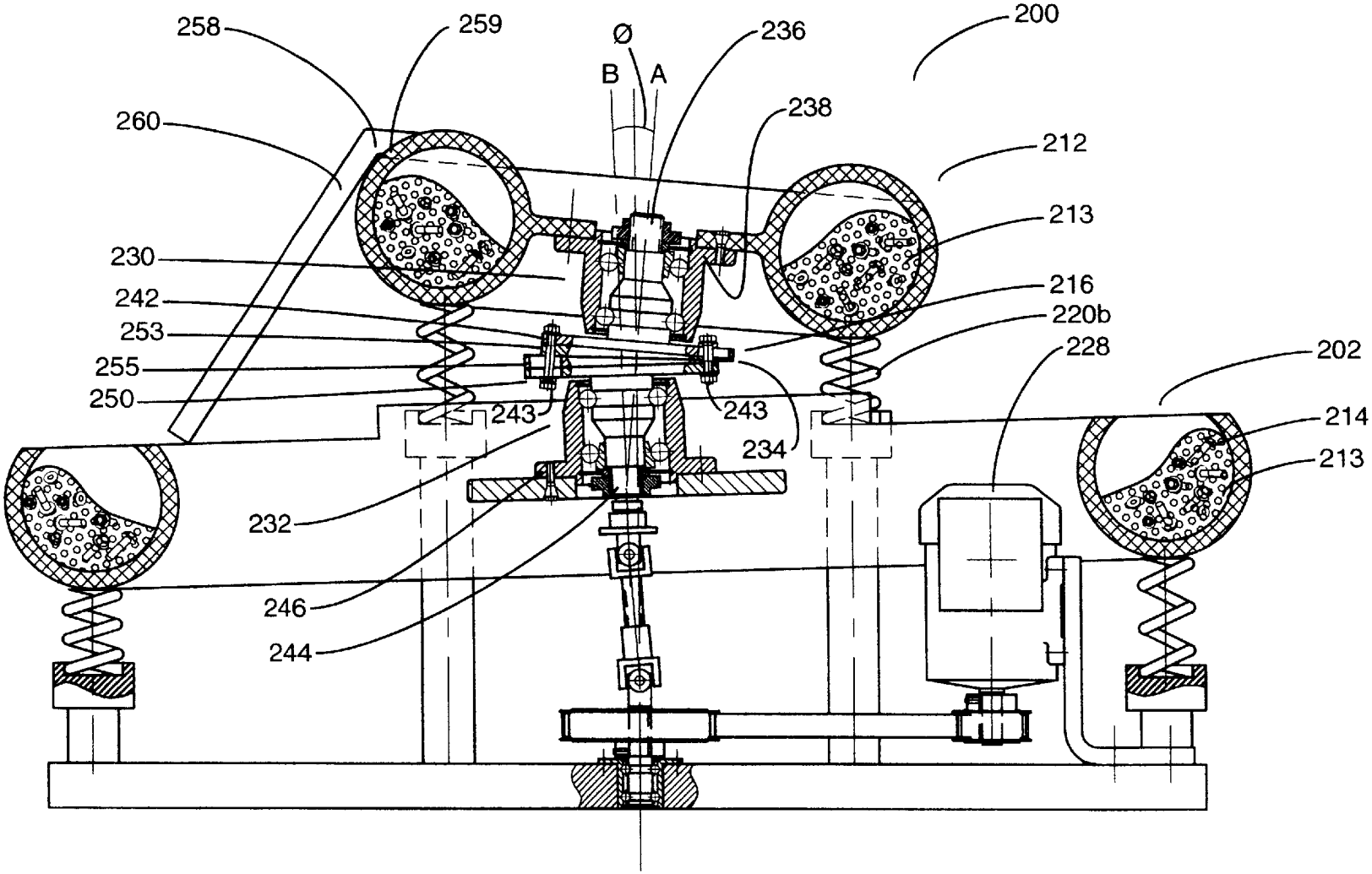
FIG. 3 is a side cross-sectional view of the finishing assembly according to another alternative embodiment of the present invention.
Figure 4:
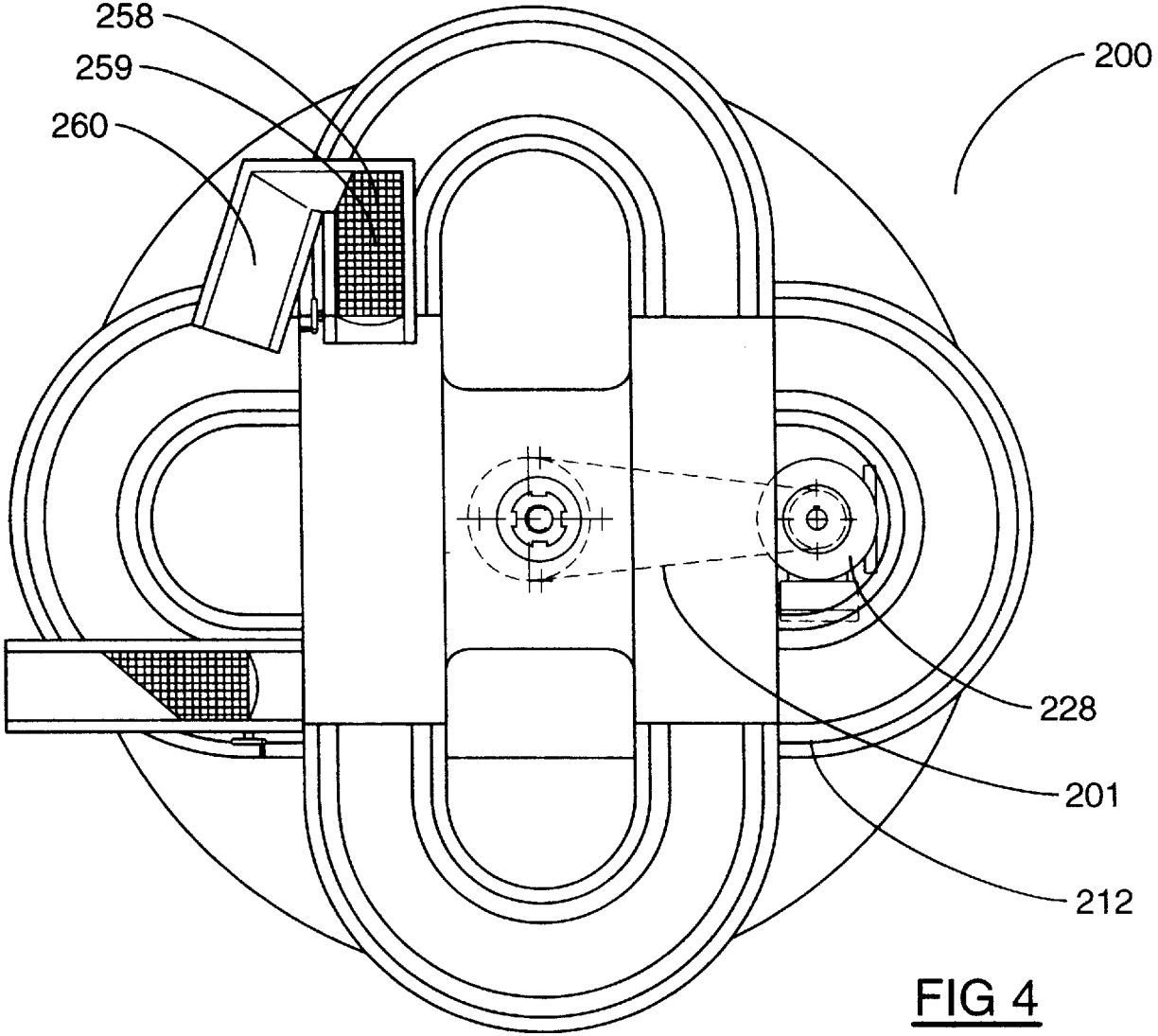
FIG. 4 is a top plan view of the embodiment of finishing assembly of FIG. 1.

FIGS. 3 and 4 show another alternative embodiment of finishing assembly 200 wherein chamber 212 and second chamber 202 are arranged in a two-stored (two-tier) design and shaped differently to allow for easy access to the contents of chamber 212 and second chamber 202. Common elements between the alternative finishing assembly 200 and the finishing assembly 10 will be denoted by the same numerals but with two hundred added thereto.

Finishing assembly 200 allows for use of identical chambers 212 and 202 and the footprint of finishing assembly 200 (i.e. the floor space necessary to house finishing assembly 200) becomes smaller. When chambers 212 and 202 are disposed close to each other, access to chamber 202 one becomes more difficult. Accordingly, it is more convenient to form chamber 202 in an oval-shaped manner. For example, chamber 202 and 212 can be made of two elongated chutes with cylindrical bottoms and connected to each other by semicircular ends having toroidal bottoms. The access to chamber 202 can be provided by placing the long sides of the 212 and 202 perpendicular to each other, as shown.

In finishing assembly 200, each chamber can be used for separate operations, so that functionally aforesaid machine can be used as two machines. The two-chamber machine is especially advantageous for multi-operation finishing technologies (primary and final grinding, drying, etc.). Each chamber 202 and 212 can be loaded with the corresponding finishing media 13 and can be provided with appropriate screens and flaps (not shown) for separation. As shown, the discharge chute 260 of the internal or the upper chamber 212, where the first operation is effected, conveys screened parts to the second chamber 202.

It should be noted that the difference in the moment of inertia about the parallel horizontal central axes gives certain advantages for optimization of vibrational characteristics for finishing assembly 200. As shown, workpieces 214 can be transferred from chamber 212 to chamber 202 from separator 258 through chute 260. Granules or particles of finishing media 213 pass through the openings in screen 259 back onto the bottom of chamber 212, while the screened workpieces 214 are conveyed by chute 260 out of chamber 212 and into second chamber 202.

Also, it may be noted that in the two-chamber embodiments of finishing assembly 100 and 200 discussed (FIGS. 2, 3, and 4), despite the absence of a special heavy housing (e.g. finishing assembly 10 shown in FIG. 1), the stability (or robustness) of the vibratory regimes to changes in weight contained in chambers 110, 102 and 210, 202, respectively is sufficiently high. This is because in the case of an equal change of weight in both chambers 110, 102 and 210, 202, respectively, the kinematical drive maintains the stability of the corresponding vibrations of the chambers occurring in opposite phases. The advantage of a two-chamber embodiment also lies in the fact that second chambers 102, 202 do not increase the load, acting on the supports, it only requires the double power of motor 128, 228 for finishing of the double weight charge.

Figure 5A:
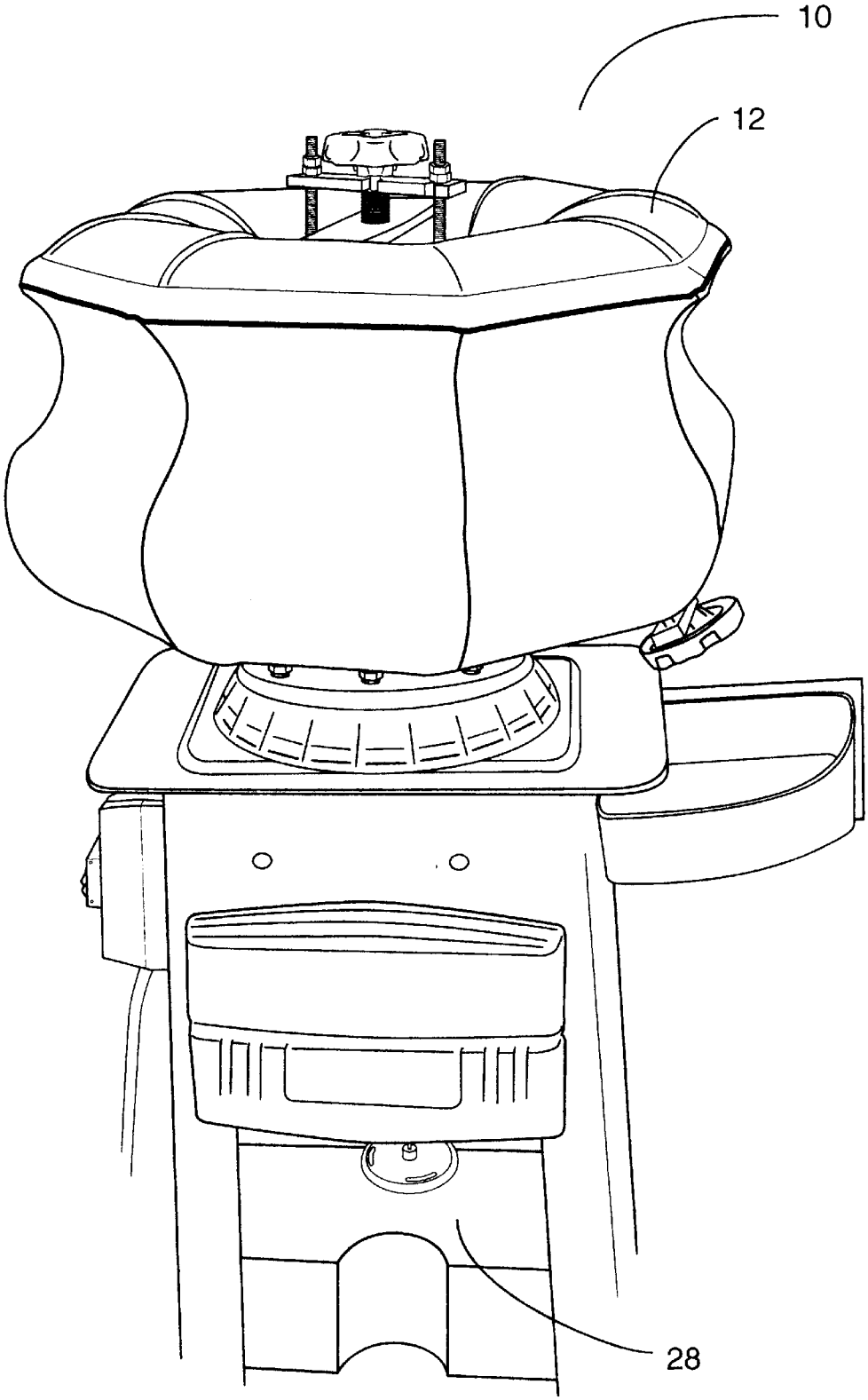
FIG. 5A is a perspective view of the finishing assembly of FIG. 1.
Figure 5B:
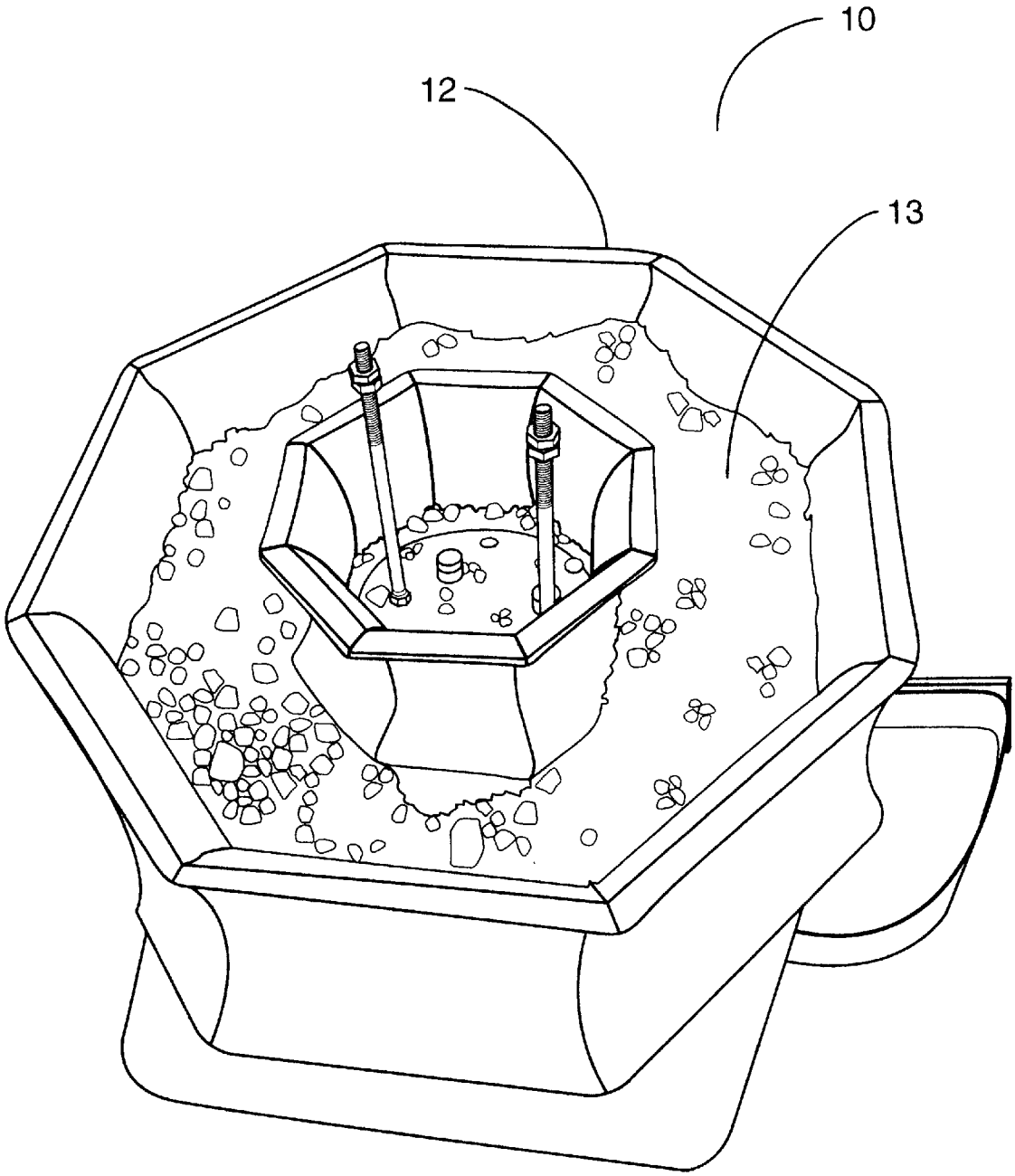
FIG. 5B is a perspective view of the chamber of FIG. 1 with its top removed.

Referring now to FIGS. 1, 5A and 5B, in use, a user loads a sufficient number of workpieces 14 into chamber 12 of finishing assembly 10. Once workpieces 14 are positioned within chamber 12, motor 28 will provide drive shaft 44 with rotational force and crank 36 will provide chamber 12 with rotational force along an axis which is oriented at an angle to the axis of the drive shaft 44. Accordingly, chamber 12 can be rotated and aggressive finishing can be accomplished using a relatively low-energy input drive system 16. Once finishing is completed, finishing assembly 10 can be turned off. Due to the kinematic design of finishing assembly 10, there is no adverse machine runout characteristic when finishing assembly 10 is turned off. Finished workpieces 14 can be removed from finishing assembly 10 either manually, or using a separator 58, screen 59 and reservoir 64 assembly described above.

Since finishing assembly 10 utilizes a kinematical drive to cause chamber 12 to experience spacial vibrations, the usual disadvantages associated with an inertia centrifugal drive mechanism are not present. Accordingly, finishing assembly 10 provides aggressive finishing action. Finishing assembly 10 also comprises relatively few parts and is durable in construction and is relatively inexpensive to manufacture. Loose finishing media 13 contained within chamber 12 has the same character of movement as is the case with known prior art finishing machines. However, chamber 12 provides greater finishing intensity to workpieces 14 at a lower noise level than is conventionally achievable. Finally, due to the kinematic connection between chamber 12 and a reactive mass (e.g. housing 18 or second chamber 102), finishing assembly 10 becomes less sensitive to changes in the weight of finishing media 13 loaded into chamber 12.

It should be understood that finishing assemblies 10, 100 and 200 can use different types of chambers 12, 112, and 212 (e.g. annular chamber with toroidal bottom, bowl, etc.) Also, it is possible to provide a plurality of individual isolated chambers mounted on the periphery of a platform for finishing small parts (e.g. watch parts). Additional well known auxiliary devices for separation of finished workpieces 14 can also be used in association with finishing assembly 10, as is conventionally known.

As will be apparent to persons skilled in the art, various modifications and adaptations of the structure described above are possible without departure from the present invention, the scope of which is defined in the appended claims.

We claim:

1. A finishing assembly for vibratory finishing of a group of workpieces within finishing media, said finishing assembly comprising:

(a) a first chamber adapted to hold the finishing media for finishing the surfaces of the workpieces;

(b) a crank shaft operably connected to said first chamber, said crank shaft having a first rotary axis;

(c) a drive shaft driveably operated and operably connected to said crank shaft for driving said crank shaft, said drive shaft having a second rotary axis;

(d) a coupling member operably connecting said crank shaft to said drive shaft with said first rotary axis of said crank shaft and said second rotary axis of said drive shaft intersecting with one another at a predetermined angle;

(e) a restraining element coupled to said first chamber for restraining said first chamber from rotational movement; and (f) a reactive mass operative connected to said drive shaft for providing vibrational stability to said finishing assembly.

2. The finishing assembly of claim 1, wherein said coupling member has a top surface and a bottom surface and said first rotary axis intersects with the top surface of said coupling member at a first point and said second rotary axis intersects with the bottom surface of said coupling member at a second point, such that said first and second points are vertically displaced by a predetermined distance.

3. The finishing assembly of claim 1, wherein said drive shaft is driveably operated by an electric motor.

4. The finishing assembly of claim 1, wherein said coupling member is a wedge shaped element.

5. The finishing assembly of claim 1, wherein said coupling member is a conjugated cylindrical element.

6. The finishing assembly of claim 1, wherein said crank shaft is rotatably mounted in a first bearing hub, said first bearing hub being rigidly coupled to said finishing chamber and said drive shaft is rotatably mounted in a second bearing hub, said second bearing hub being rigidly coupled to said reactive mass.

7. The finishing assembly of claim 6, wherein said first and second bearing hubs are automobile wheel bearing supports.

8. The finishing assembly of claim 1, wherein said reactive mass is a housing coupled to a shock absorber member.

9. The finishing assembly of claim 1, wherein said reactive mass is a second chamber adapted to hold a second amount of finishing media for further finishing of the surfaces of the workpieces.

10. The finishing assembly of claim 9, wherein a chute is coupled to said first chamber and positioned over said second chamber for conveying the workpieces from said first chamber to said second chamber.

11. The finishing assembly of claim 9, wherein said second chamber is located in the same plane and positioned coaxially with said first chamber.

12. The finishing assembly of claim 9, wherein said second chamber is mounted in a plane located below the plane of said first chamber.

* * * * *